US009610784B2

(12) United States Patent
Hamada

(10) Patent No.: US 9,610,784 B2
(45) Date of Patent: Apr. 4, 2017

(54) MEDIUM SUPPORTING UNIT, RECORDING APPARATUS, AND MEDIUM SUPPORTING METHOD

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/042,018

(22) Filed: Feb. 11, 2016

(65) Prior Publication Data

US 2016/0243849 A1 Aug. 25, 2016

(30) Foreign Application Priority Data

Feb. 24, 2015 (JP) ..... 2015-033753

(51) Int. Cl.
*B41J 11/06* (2006.01)
*B41J 11/00* (2006.01)
*B41J 3/407* (2006.01)

(52) U.S. Cl.
CPC ..... *B41J 11/06* (2013.01); *B41J 11/0005* (2013.01); *B41J 3/4078* (2013.01)

(58) Field of Classification Search
CPC ..... B41J 3/407
See application file for complete search history.

(56) References Cited

U.S. PATENT DOCUMENTS

2003/0197772 A1* 10/2003 Iwatsuki ..... B41J 11/06 347/104
2006/0055734 A1* 3/2006 Kadomatsu ..... B41J 2/14233 347/55
2011/0310398 A1* 12/2011 Okano ..... G01N 21/55 356/600
2014/0368593 A1* 12/2014 Kanasugi ..... B41J 2/0057 347/103

FOREIGN PATENT DOCUMENTS

JP 2004-291461 10/2004
JP 2006-123361 5/2006
JP 3969168 6/2007

* cited by examiner

*Primary Examiner* — Alessandro Amari
*Assistant Examiner* — Roger W Pisha, II
(74) *Attorney, Agent, or Firm* — Workman Nydegger

(57) ABSTRACT

A medium supporting unit includes a supporting unit which can support a medium, and a pressing unit which can press the medium which is supported by the supporting, in which a coefficient of static friction of a contact face with the medium in the pressing unit is larger than that of a contact face with the medium in the supporting unit. By configuring such a medium supporting unit, it is possible to suppress floating of the medium.

11 Claims, 6 Drawing Sheets

MEDIUM SUPPORTING UNIT, RECORDING APPARATUS, AND MEDIUM SUPPORTING METHOD

BACKGROUND

1. Technical Field

The present invention relates to a medium supporting unit, a recording apparatus, and a medium supporting method.

2. Related Art

In the related art, a medium supporting unit which includes a pressing unit which can press a medium supported by a supporting unit has been used. It is possible to set a medium by suppressing floating of the medium by pressing the medium using the pressing unit.

For example, in JP-A-2004-291461, a recording apparatus (ink jet printer) which includes a medium supporting unit including a platen as a supporting unit, and a fixing frame as a pressing unit which can press a medium which is supported by the platen is disclosed. Here, an antislip member which is made of rubber is formed inside the fixing frame.

As a result of earnest examinations of the inventors, it was understood that a relationship in a coefficient of static friction between a contact face with a medium in a pressing unit and a contact face with the medium in a supporting unit is important in order to suppress floating of the medium in the medium supporting unit which includes the pressing unit which can press the medium which is supported by the supporting unit.

However, in JP-A-2004-291461, the relationship in the coefficient of static friction between the contact face with the medium in the pressing unit and the contact face with the medium in the supporting unit is not described. For this reason, in the medium supporting unit of the recording apparatus (ink jet printer) which is disclosed in JP-A-2004-291461, it is considered that there is a concern that floating of the medium may not be suppressed.

SUMMARY

An advantage of some aspects of the invention is to suppress floating of a medium in a medium supporting unit which includes a pressing unit which can suppress the medium supported by a supporting unit.

According to an aspect of the invention, there is provided a medium supporting unit which includes a supporting unit which can support a medium, and a pressing unit which can press the medium supported by the supporting unit, in which a coefficient of static friction of a contact face with the medium in the pressing unit is larger than that of a contact face with the medium in the supporting unit.

In the medium supporting unit, the contact face with the medium in the pressing unit may be formed of a soft polymeric substance.

In the medium supporting unit, the contact face with the medium in the pressing unit may be formed with unevenness.

In the medium supporting unit, a painting layer of which a coefficient of static friction is larger than that of the contact face with the medium in the supporting unit may be formed on the contact face with the medium in the pressing unit.

In the medium supporting unit, the contact face with the medium in the supporting unit may be formed of a hard polymeric substance.

In the medium supporting unit, a coefficient of static friction on the entire surface of the pressing unit may be larger than that of the contact face with the medium in the supporting unit.

According to another aspect of the invention, there is provided a recording apparatus which includes the medium supporting unit according to the aspect, and a recording unit which can perform recording on a medium which is supported by the medium supporting unit.

According to still another aspect of the invention, there is provided a medium supporting method in a medium supporting unit which includes a supporting unit which can support a medium, and a pressing unit which can press the medium supported by the supporting unit, the method including setting a coefficient of static friction of a contact face with the medium in the pressing unit to be larger than that of a contact face with the medium in the supporting unit.

According to the invention, it is possible to suppress floating of a medium in a medium supporting unit which includes a pressing unit which can press a medium supported by a supporting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a medium supporting unit 2 according to an embodiment of the invention, and a recording apparatus 1 according to the embodiment which includes the medium supporting unit 2 will be described in detail with reference to accompanying drawings.

First, an outline of the recording apparatus 1 according to the embodiment will be described.

Figure 1:
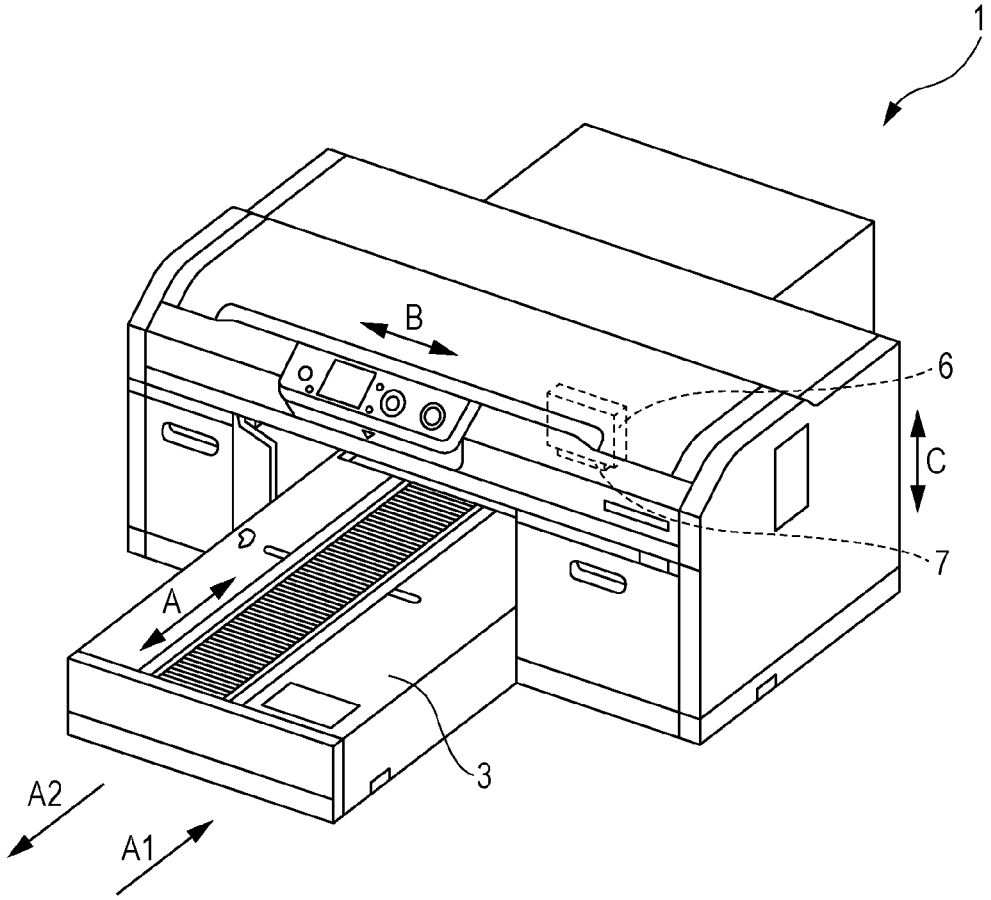
FIG. 1 is a perspective view which schematically illustrates a recording apparatus according to an embodiment of the invention.
Figure 2:
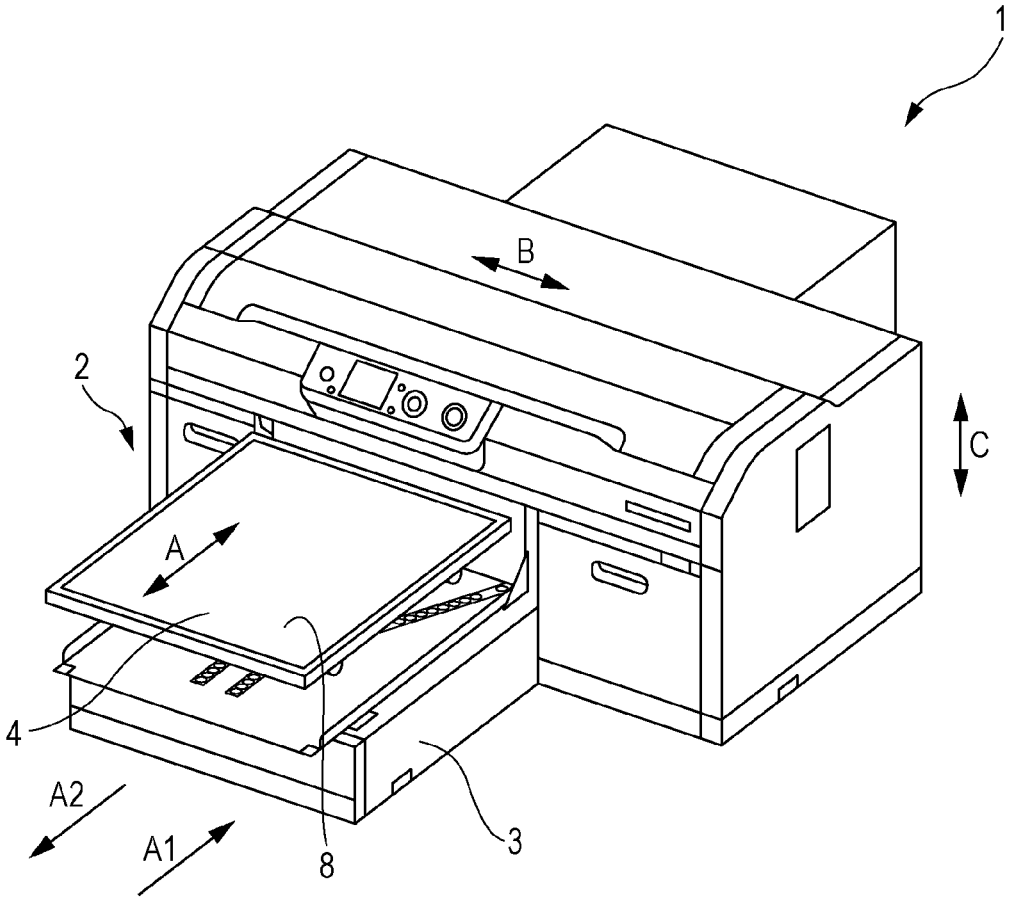
FIG. 2 is a perspective view which schematically illustrates the recording apparatus according to the embodiment of the invention.

FIGS. 1 and 2 are perspective views which schematically illustrate the recording apparatus 1 according to the embodiment, and in the figures, FIG. 1 illustrates a state in which a tray 4 as a supporting unit of a medium M (refer to FIG. 4) of the recording apparatus 1 according to the embodiment is located at a recording start position, and FIG. 2 illustrates a state in which the tray 4 is located at a setting position of the medium M.

Figure 3:
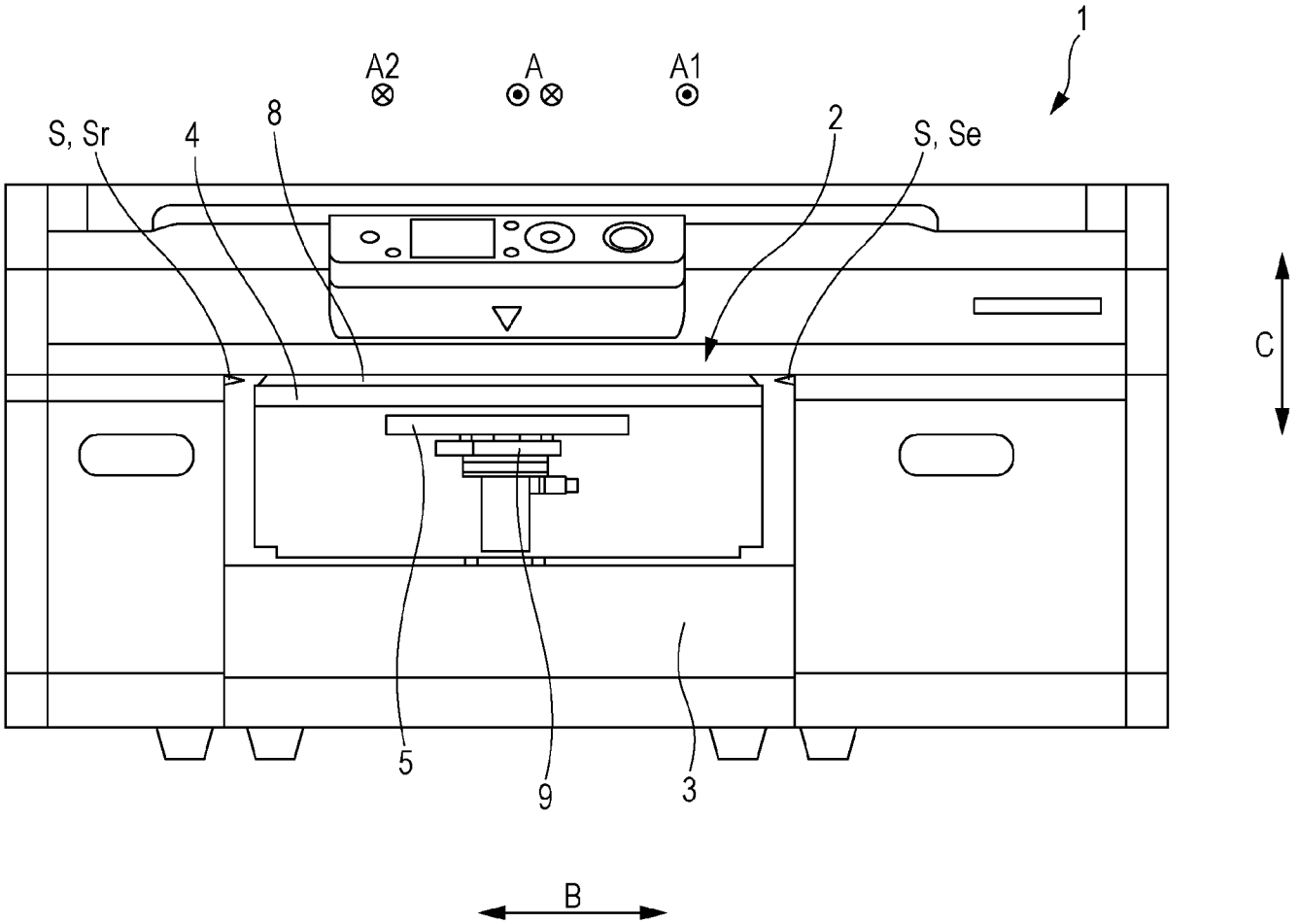
FIG. 3 is a perspective view which schematically illustrates the recording apparatus according to the embodiment of the invention.

In addition, FIG. 3 is a front view which schematically illustrates the recording apparatus 1 according to the embodiment.

The recording apparatus 1 according to the embodiment includes the medium supporting unit 2 which moves in a movement direction A in a state in which the medium M is supported on a supporting face 8 of the tray 4. The medium supporting unit 2 includes the tray 4 which is a supporting unit of the medium M. The recording apparatus 1 includes a medium transport unit 3 which transports the medium M supported by the tray 4 in the movement direction A. The movement direction A is a direction which includes a direction A1, and a direction A2 which is opposite to the direction A1. In addition, the tray 4 is mounted on a stage 5. The tray 4 moves together with the stage 5 in a height direction C when a rotary lever 9 is rotated. As the medium M, it is possible to use various materials such as textile (woven stuff, cloth, or the like), paper, a polyvinyl chloride resin.

In addition, a recording head 7 which can perform recording on the medium M by ejecting ink is included in the inside of a main body of the recording apparatus 1. In the embodiment, the recording head 7 corresponds to a recording unit which can perform recoding on the medium M. In addition, the recording apparatus 1 according to the embodiment forms a desired image by ejecting ink onto the medium M which is supported by the tray 4 from the recording head 7 while causing the recording head 7 to reciprocate in an intersecting direction B, by causing a carriage 6 in which the recording head 7 is provided to reciprocate in the intersecting direction B which intersects the movement direction A.

In the recording apparatus 1 according to the embodiment, a near side (lower left direction) in FIGS. 1 and 2 is a setting position (corresponding to FIG. 2) of the medium M with respect to the tray 4. In addition, recording is performed while moving the tray 4 in the direction A2 in the movement direction A, after moving the tray 4 in which the medium M is set in the direction A1 in the movement direction A to a recording start position (corresponding to FIG. 1) on a depth side (higher right direction) in FIGS. 1 and 2.

The recording apparatus 1 according to the embodiment includes the recording head 7 which performs recording while reciprocating in the intersecting direction B; however, the recording apparatus may be a recording apparatus which includes a so-called line head in which a plurality of nozzles which eject ink are provided in the intersecting direction B which intersects the movement direction A.

Here, the "line head" is a recording head which is used in a recording apparatus in which a region of nozzles which are formed in the intersecting direction B which intersects the movement direction A of the medium M is provided so as to cover the entire intersecting direction B of the medium M, and which forms an image by relatively moving a recording head or a medium M. In addition, the region of the nozzle in the intersecting direction B of the line head may not cover the entire intersecting direction B of all of the mediums M to which the recording apparatus 1 corresponds.

In addition, the recording head 7 according to the embodiment is a recording unit which can perform recording by ejecting ink on the medium M; however, it is not limited to such a recording unit, and for example, a transfer-type recording unit which performs recording by transferring a coloring material onto the medium M may be used.

The recording apparatus 1 according to the embodiment includes a sensor S as illustrated in FIG. 3, and it is possible to detect whether or not an interval between the medium M supported by the tray 4 and the recording head 7 is abnormal (interval between medium M and recording head 7 is excessively small).

Here, the sensor S includes a light emitting unit Se and a light receiving unit Sr. In addition, the sensor S has a configuration in which whether or not the interval is abnormal is detected by determining whether or not light is received in the light receiving unit Sr, by radiating the light from the light emitting unit Se to the light receiving unit Sr. However, the configuration is not limited to this.

Subsequently, the medium supporting unit 2 according to the embodiment will be described in detail.

Figure 4:
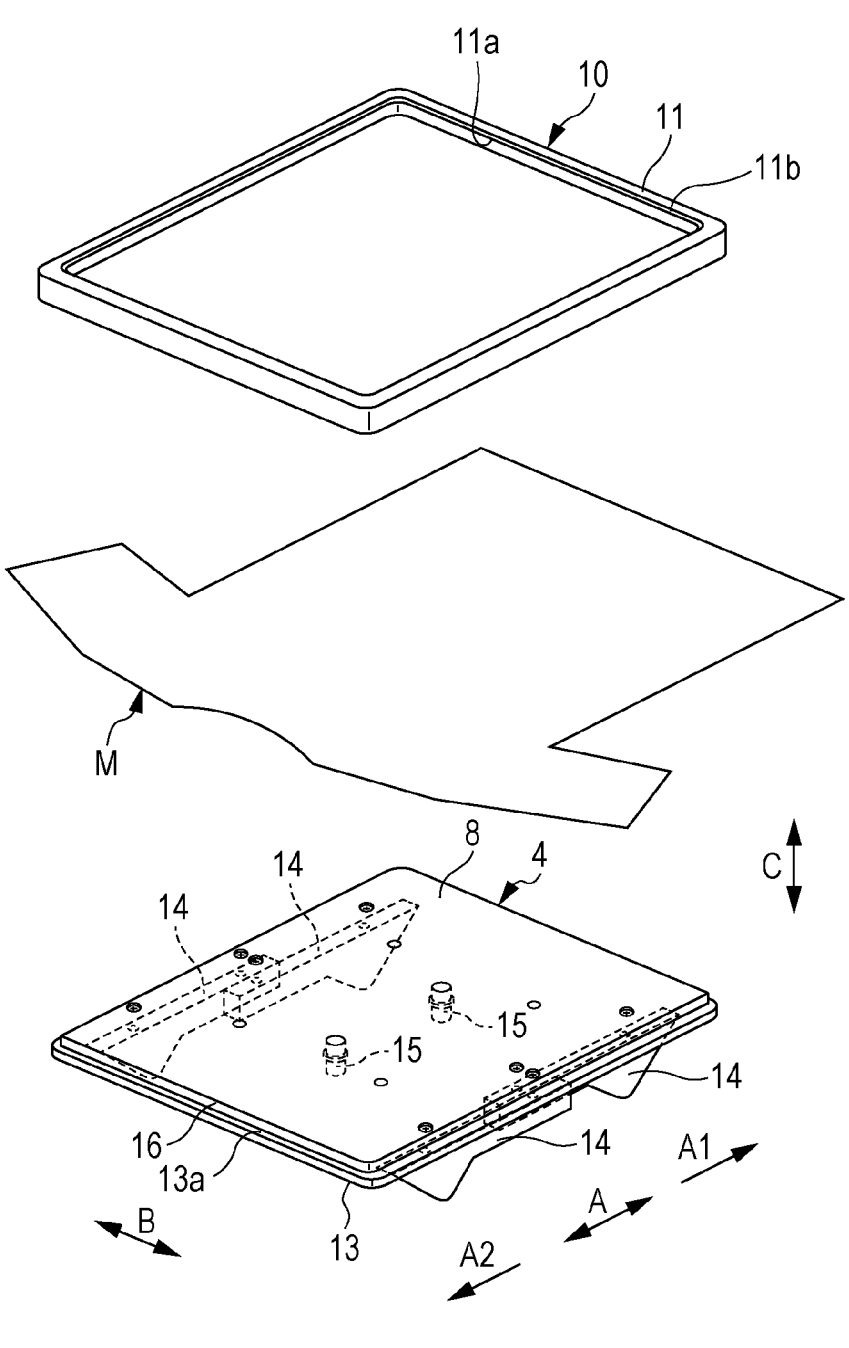
FIG. 4 is a perspective view which schematically illustrates a medium supporting unit according to the embodiment of the invention.

Here, FIG. 4 is a perspective view which schematically illustrates the medium supporting unit 2 according to the embodiment. In addition, FIGS. 5A and 5B are side-sectional views which schematically illustrate the medium supporting unit 2 according to the embodiment.

Figure 5A:
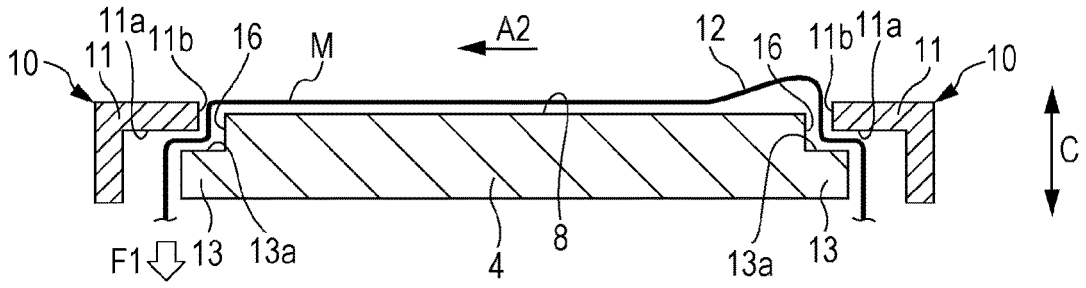
FIGS. 5A and 5B are side-sectional views which schematically illustrate the medium supporting unit according to the embodiment of the invention.
Figure 5B:
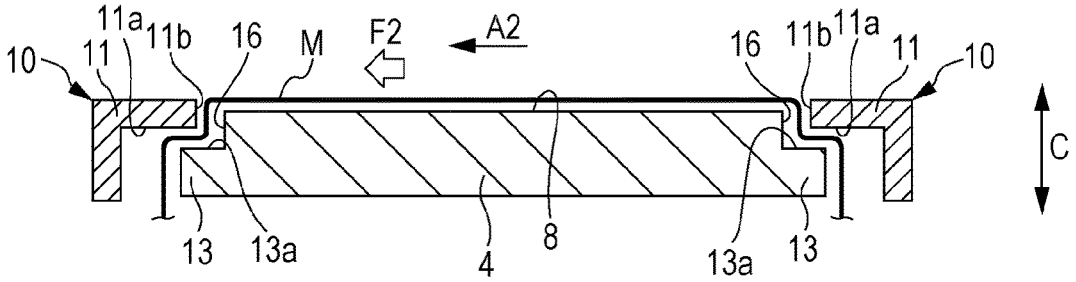
Figure 6A:
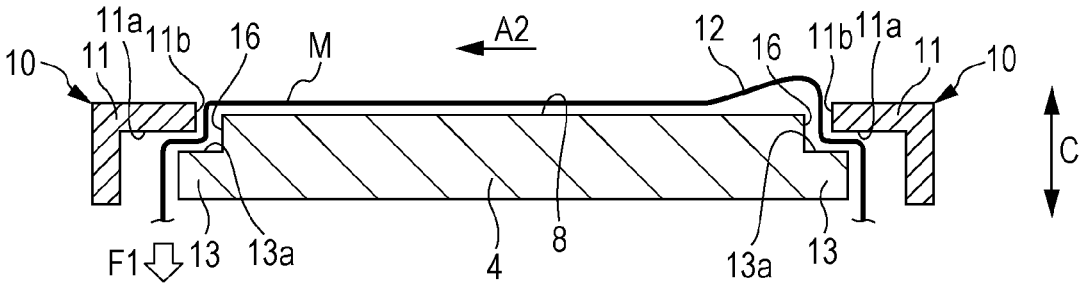
FIGS. 6A to 6C are side-sectional views which schematically illustrate a medium supporting unit in a comparison example.
Figure 6B:
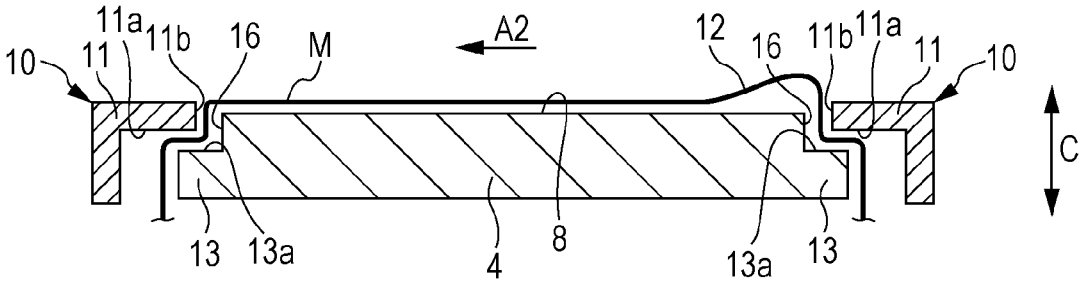
Figure 6C:
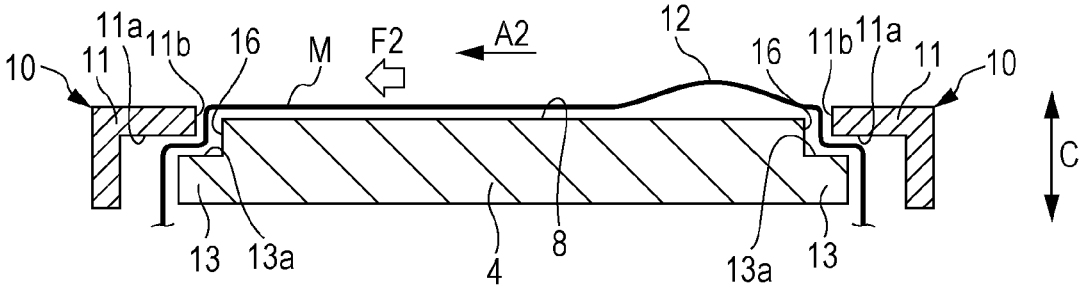

Meanwhile, FIGS. 6A to 6C are side-sectional views which schematically illustrate a medium supporting unit in a comparison example, and are figures which correspond to FIGS. 5A and 5B which illustrate the medium supporting unit 2 according to the embodiment.

As illustrated in FIGS. 4, 5A and 5B, the medium supporting unit 2 according to the embodiment includes the tray 4 as the supporting unit which can support the medium M, and a frame-shaped pressing unit 10 which can press the medium M which is supported by the tray 4.

In addition, a lower face 11*a* and the side face 11*b* of eaves 11 which are contact faces with the medium M in the pressing unit 10 are configured so that coefficients of static friction thereof are larger than those of a supporting face 8, a higher face 13*a* of and edge portion 13, and a side face 16 of the supporting face 8 as contact faces with the medium M in the tray 4. In other words, it is a configuration in which the coefficient of static friction of the contact face with the medium M in the pressing unit 10 is set to be larger than a coefficient of static friction of the contact face with the medium M in a supporting unit 4.

As a result of the earnest examination of the inventors, the fact that it is possible to suppress floatation 12 of the medium M by setting a coefficient of static friction of the contact face with the medium M in the pressing unit 10 to be larger than that of the contact face with the medium M in the tray 4 was found.

In this manner, since the medium supporting unit 2 according to the embodiment is configured so that the coefficient of static friction of the contact face with the medium M in the pressing unit 10 is set to be larger than that of the contact face with the medium M in the tray 4, it is possible to suppress the floatation 12 of the medium M.

In addition, in other words, the recording apparatus 1 according to the embodiment is configured so that it is possible to perform recording by suppressing the floatation 12 of the medium M.

When expressing it in other words, it is possible to suppress floating of the medium by setting the coefficient of static friction of the contact face with the medium M in the pressing unit 10 to be larger than that of the contact face with the medium M in the tray 4 using the medium supporting unit 2 according to the embodiment.

Here, FIG. 5A illustrates a state in which, in the medium supporting unit 2 according to the embodiment, the pressing unit 10 is combined with the tray 4 on which medium M is mounted from a state illustrated in FIG. 4 (state in which medium M is going to be set in tray 4), and a state in which the floatation 12 occurred on the upstream side in the direction A2 at this time.

In addition, FIG. 5B illustrates a state in which a worker pulls the medium M toward a direction F1 at a position on the downstream side in the direction A2 (position on the near side (lower left direction on paper plane) of recording apparatus 1 in FIGS. 1 and 2) from the state illustrated in FIG. 5A, and the floatation 12 is eliminated.

In this manner, in the medium supporting unit 2 according to the embodiment, the floatation 12 is eliminated when the medium M on the supporting face 8 moves in a direction F2, along with pulling of the medium M in the direction F1. The reason for this is that only the medium M on the supporting face 8 moves in the direction F2 when the medium M is pulled in a state of being firmly pressed by the pressing unit 10 on the upstream side in the direction A2, by setting the coefficient of static friction of the contact face with the medium M in the pressing unit 10 to be larger than that of the contact face with the medium M in the tray 4.

Meanwhile, FIG. 6A illustrates a medium supporting unit according to a comparison example in which a coefficient of static friction of a contact face with the medium M in the pressing unit 10 is smaller than that of a contact face with the medium M in the tray 4. FIG. 6A illustrates a state in which, in the medium supporting unit in the comparison example, the pressing unit 10 is combined with the tray 4 on which the medium M is mounted, from the state illustrated in FIG. 4, and a state in which the floatation 12 occurred on the upstream side in the direction A2, at this time. In addition, the state is the same as the state in FIG. 5A.

In addition, both FIGS. 6B and 6C illustrate a state in which a worker pulls the medium M toward the direction F1 at a position on the downstream side in the direction A2 (position on the near side (lower left direction on paper plane) of recording apparatus 1 in FIGS. 1 and 2) from the state illustrated in FIG. 6A, and the floatation 12 is eliminated.

Between these, FIG. 6B illustrates a state in which the coefficient of static friction of the contact face with the medium M in the tray 4 is excessively large. FIG. 6B illustrates a state in which the medium M on the supporting face 8 does not move even when a worker pulls the medium M in the direction F1 from the state illustrated in FIG. 6A, and the floatation 12 is not eliminated.

In addition, FIG. 6C illustrates a case in which the coefficient of static friction of the contact face with the medium M in the pressing unit 10 is excessively small. FIG. 6C illustrates a state in which the whole medium M moves in the direction F2 along with pulling of the medium M in the direction F1 by a worker, from the state illustrated in FIG. 6A, and only a position of the floatation 12 is moved (state in which floatation 12 is not eliminated). The reason for this is that, though there is a portion which easily floats in the medium M, when the medium M slips on the contact face with the medium M in the pressing unit 10, and it is not possible to pull the portion from both sides using an appropriate tensile force, the floatation 12 is not easily eliminated.

In this manner, in the medium supporting unit according to the comparison example in which the coefficient of static friction of the contact face with the medium M in the pressing unit 10 is smaller than that of the contact face with the medium M in the tray 4, in both the case in which the coefficient of static friction of the contact face with the medium M in the tray 4 is excessively large and the case in which the coefficient of static friction of the contact face with the medium M in the pressing unit 10 is excessively small, it is difficult to eliminate the floatation 12.

In addition, in the pressing unit 10 according to the embodiment, the entire surface is formed of a rubber material of which a coefficient of static friction is large. That is, in other words, the contact face with the medium M in the pressing unit 10 is formed of a soft polymeric substance. For this reason, the pressing unit has a configuration in which the floatation 12 of the medium M can be effectively suppressed.

Here, as the "soft polymeric substance", it is possible to use a rubber material such as urethane rubber or silicone rubber, and an adhesive polymeric substance, or the like; however, it is not particularly limited.

In addition, the pressing unit 10 according to the embodiment is configured so that the surface of a metallic framework is covered with a rubber material; however, it is not limited to such a configuration. For example, the entire pressing unit 10 including the inside may be formed of a soft polymeric material.

In addition, unevenness may be formed on the contact face with the medium M in the pressing unit 10. That is, a surface treatment for making a coefficient of static friction large may be performed on the contact face with the medium M in the pressing unit 10. The reason for this is that it is possible to effectively suppress the floatation 12 of the medium M when the surface treatment for making the coefficient of static friction large is performed.

A forming method of the "unevenness" is not particularly limited; however, for example, by performing blast processing, or the like, it is possible to form the unevenness on the contact face with the medium M in the pressing unit 10.

A painting layer of which a coefficient of static friction is larger than that of the contact face with the medium M in the tray 4 may be formed on the contact face with the medium M in the pressing unit 10. That is, painting such as embossing painting using baking for making the coefficient of static friction large may be performed on the contact face with the medium M in the pressing unit 10. The reason for this is that it is possible to effectively suppress the floatation 12 of the medium M when the painting for making the coefficient of static friction large is performed.

In addition, a forming method of the "painting layer" is not particularly limited; however, for example, it is possible to perform the embossing painting, or the like, using baking.

The entire tray 4 according to the embodiment is formed of an acrylic resin which is a hard polymeric substance of which a coefficient of static friction is small. That is, in other words, the contact face with the medium M in the tray 4 is formed of a hard polymeric substance. For this reason, for example, it is possible to simply eliminate the floatation 12 of the medium M when setting the medium M in the tray 4.

Here, the "hard polymeric substance" is not particularly limited; however, it is possible to use polyethylene, polypropylene, polystyrene, polyethylene terephthalate, or the like, for example, in addition to the acrylic resin.

As described above, the entire surface of the pressing unit 10 according to the embodiment is formed of a rubber material of which a coefficient of static friction is large, and in the entire surface of the pressing unit 10, the coefficient of static friction is larger than that of the contact face with the medium M in the tray 4. For this reason, it is a configuration in which it is not only possible to suppress the floatation 12 of the medium M, but to improve workability when a worker causes the medium supporting unit 2 to support the medium M, or the like, since the pressing unit 10 becomes hard to be slippery when the worker holds the pressing unit 10. However, a coefficient of static friction on a part of the surface of the pressing unit 10 may be the coefficient of static friction or less of the contact face with the medium M in the tray 4. Also in this case, it is preferable that at least a coefficient of static friction on the entire contact face with the medium M in the pressing unit 10 is larger than that of the contact face with the medium M in the tray 4. In this manner, it is possible to suppress the floatation 12 of the medium M even in a case in which a coefficient of static friction on the entire surface of the pressing unit 10 is not larger than that of the contact face with the medium M in the tray 4.

As illustrated in FIG. 4, the tray 4 according to the embodiment includes an installation unit 14 which is used when the tray is installed on a floor, or the like, by being detached from the stage 5, and a positioning unit 15 with which it is possible for the tray to be positioned with respect to the stage 5. However, the configuration of the tray 4 is not particularly limited.

It is needless to say that the invention can be variously modified within the scope of the invention which is described in claims without being limited to the above described embodiment, and those are also included in the scope of the invention.

Hitherto, the invention has been described based on a specific embodiment. Here, the invention will be collectively described again.

The medium supporting unit 2 according to an aspect of the invention includes the supporting unit 4 which can support the medium M, and the pressing unit 10 which can press the medium M supported by the supporting unit 4, and in which coefficients of static friction of the contact faces 11*a* and 11*b* with the medium M in the pressing unit 10 are larger than those of the contact faces 8, 13*a*, and 16 with the medium M in the supporting unit 4.

As a result of earnest examinations of the inventors, the fact that it is possible to suppress the floatation 12 of the medium M by setting the coefficients of static friction of the contact faces 11*a* and 11*b* with the medium M in the pressing unit 10 to be larger than those of the contact faces 8, 13*a*, and 16 with the medium M in the supporting unit 4 was found.

According to the aspect, the coefficients of static friction of the contact faces 11*a* and 11*b* with the medium M in the pressing unit 10 are larger than those of the contact faces 8, 13*a*, and 16 with the medium M in the supporting unit 4. For this reason, it is possible to suppress the floatation 12 of the medium M.

In the medium supporting unit 2 in the aspect of the invention, the contact faces 11*a* and 11*b* with the medium M in the pressing unit 10 is formed of a soft polymeric substance.

According to the aspect the contact faces 11*a* and 11*b* with the medium M in the pressing unit 10 is formed of the soft polymeric substance. That is, the contact faces 11*a* and 11*b* with the medium M in the pressing unit 10 are formed of the soft polymeric substance such as a rubber material of which a coefficient of static friction is generally large. For this reason, it is possible to effectively suppress the floatation 12 of the medium M.

In addition, the "soft polymeric substance" is not particularly limited; however, for example, it is possible to use a rubber material such as urethane rubber or silicone rubber, and an adhesive polymeric substance, or the like.

In the medium supporting unit 2 in the aspect of the invention, unevenness is formed on the contact faces 11*a* and 11*b* with the medium M in the pressing unit 10.

According to the aspect, unevenness is formed on the contact faces 11*a* and 11*b* with the medium M in the pressing unit 10. That is, in the contact faces 11*a* and 11*b* with the medium M in the pressing unit 10, a surface treatment for making a coefficient of static friction large is performed. For this reason, it is possible to effectively suppress the floatation 12 of the medium M.

A forming method of the "unevenness" is not particularly limited; however, for example, by performing blast processing, or the like, it is possible to form the unevenness on the contact faces 11*a* and 11*b* with the medium M in the pressing unit 10.

In the medium supporting unit 2 in the aspect of the invention, painting layers of which the coefficients of static friction are larger than those of the contact faces 8, 13*a*, and 16 with the medium M in the supporting unit 4 are formed on the contact faces 11*a* and 11*b* with the medium M in the pressing unit 10.

According to the aspect, the paining layers of which the coefficients of static friction are larger than those of the contact faces 8, 13*a*, and 16 with the medium M in the supporting unit 4 are formed on the contact faces 11*a* and 11*b* with the medium M in the pressing unit 10. For this reason, it is possible to effectively suppress the floatation 12 of the medium M.

In addition, a forming method of the "painting layer" is not particularly limited; however, for example, it is possible to perform embossing printing using baking.

In the medium supporting unit 2 in the aspect of the invention, the contact faces 8, 13*a*, and 16 with the medium M in the supporting unit 4 are formed of a hard polymeric substance.

According to the aspect, the contact faces 8, 13*a*, and 16 with the medium M in the supporting unit 4 are formed of a hard polymeric substance. That is, the contact faces 8, 13*a*, and 16 with the medium M in the supporting unit 4 are formed of a hard polymeric substance of which a coefficient of static friction is generally small. For this reason, it is possible to simply eliminate the floatation 12 of the medium M when setting the medium M in the supporting unit 4, or the like.

The "hard polymeric substance" is not particularly limited; however, it is possible to use an acrylic resin, polyethylene, polypropylene, polystyrene, polyethylene terephthalate, or the like, for example.

In the medium supporting unit 2 in the aspect of the invention, the coefficient of static friction on the entire surface of the pressing unit 10 is larger than those of the contact faces 8, 13*a*, and 16 with the medium M in the supporting unit 4.

According to the aspect, on the entire surface of the pressing unit 10, the coefficient of static friction is larger than those of the contact faces 8, 13*a*, and 16 with the medium M in the supporting unit 4. For this reason, it is not only possible to suppress the floatation 12 of the medium M, but to improve workability when a worker causes the medium supporting unit 2 to support the medium M, or the like, since the pressing unit 10 becomes hard to be slippery when the worker holds the pressing unit 10.

The recording apparatus 1 according to another aspect of the invention includes the medium supporting unit 2 according to any one of the first to sixth embodiments, and the recording unit 7 which can perform recording on the medium M which is supported by the medium supporting unit 2.

According to the aspect, it is possible to perform recording by suppressing the floatation 12 of the medium M.

The medium supporting method according to still another aspect of the invention is a medium supporting method in the medium supporting unit 2 which includes the supporting unit 4 which can support the medium M, and the pressing unit 10 which can press the medium M supported by the supporting unit 4, in which the coefficients of static friction of the contact faces 11*a* and 11*b* with the medium M in the pressing unit 10 are set to be larger than those of the contact faces 8, 13*a*, and 16 with the medium M in the supporting unit 4.

According to the aspect, the coefficients of static friction of the contact faces 11*a* and 11*b* with the medium M in the pressing unit 10 are set to be larger than those of the contact faces 8, 13*a*, and 16 with the medium M in the supporting unit 4. For this reason, it is possible to suppress the floatation 12 of the medium M.

The entire disclosure of Japanese Patent Application No. 2015-033753, filed Feb. 24, 2015 is expressly incorporated reference herein.

What is claimed is:

1. A medium supporting unit comprising:

a supporting unit which can support a medium; and a pressing unit which can press the medium supported by the supporting unit, wherein a coefficient of static friction of a contact face with the medium in the pressing unit is larger than that of a contact face with the medium in the supporting unit, wherein a painting layer of which a coefficient of static friction is larger than that of the contact face with the medium in the supporting unit is formed on the contact face with the medium in the pressing unit.

2. The medium supporting unit according to claim 1, wherein the contact face with the medium in the pressing unit is formed of a soft polymeric substance.

3. A recording apparatus comprising:

the medium supporting unit according to claim 2; and a recording unit which can perform recording on the medium which is supported by the medium supporting unit.

4. The medium supporting unit according to claim 1, wherein the contact face with the medium in the pressing unit is formed with unevenness.

5. A recording apparatus comprising:

the medium supporting unit according to claim 4; and a recording unit which can perform recording on the medium which is supported by the medium supporting unit.

6. The medium supporting unit according to claim 1, wherein the contact face with the medium in the supporting unit is formed of a hard polymeric substance.

7. A recording apparatus comprising:

the medium supporting unit according to claim 6; and a recording unit which can perform recording on the medium which is supported by the medium supporting unit.

8. The medium supporting unit according to claim 1, wherein a coefficient of static friction on the entire surface of the pressing unit is larger than that of the contact face with the medium in the supporting unit.

9. A recording apparatus comprising:

the medium supporting unit according to claim 8; and a recording unit which can perform recording on the medium which is supported by the medium supporting unit.

10. A recording apparatus comprising:

the medium supporting unit according to claim 1; and a recording unit which can perform recording on the medium which is supported by the medium supporting unit.

11. A medium supporting method in a medium supporting unit which includes a supporting unit which can support a medium, and a pressing unit which can press the medium supported by the supporting unit, the method comprising:

setting a coefficient of static friction of a contact face with the medium in the pressing unit to be larger than that of a contact face with the medium in the supporting unit, and forming on the contact face with the medium in the pressing unit a painting layer of which a coefficient of static friction is larger than that of the contact face with the medium in the supporting unit.

* * * * *